US011702264B2

(12) United States Patent
Kumar et al.

(10) Patent No.: US 11,702,264 B2
(45) Date of Patent: Jul. 18, 2023

(54) PACKAGED ORAL CARE IMPLEMENT AND PACKAGED SET THEREOF

(71) Applicant: Colgate-Palmolive Company, New York, NY (US)

(72) Inventors: Maneesh Kumar, Mumbai (IN); Devesh Badola, Mumbai (IN); Swapnil Raut, Mumbai (IN)

(73) Assignee: Colgate-Palmolive Company, New York, NY (US)

( * ) Notice: Subject to any disclaimer, the term of this patent is extended or adjusted under 35 U.S.C. 154(b) by 81 days.

(21) Appl. No.: 17/250,611

(22) PCT Filed: Aug. 8, 2019

(86) PCT No.: PCT/US2019/045702

§ 371 (c)(1),
(2) Date: Feb. 10, 2021

(87) PCT Pub. No.: WO2020/033684

PCT Pub. Date: Feb. 13, 2020

(65) Prior Publication Data

US 2021/0179331 A1 Jun. 17, 2021

Related U.S. Application Data

(60) Provisional application No. 62/717,066, filed on Aug. 10, 2018.

(51) Int. Cl.
*B65D 75/36* (2006.01)
*B65D 75/52* (2006.01)

(52) U.S. Cl.
CPC ..... *B65D 75/366* (2013.01); *B65D 75/367* (2013.01); *B65D 75/522* (2013.01); *B65D 75/527* (2013.01); *B65D 2575/367* (2013.01)

(58) Field of Classification Search
CPC .. B65D 75/366; B65D 75/367; B65D 75/522; B65D 75/527; B65D 2575/367; A45D 44/18
(Continued)

(56) References Cited

U.S. PATENT DOCUMENTS 3,730,335 A * 5/1973 Tarrson ..... B65D 5/4204 206/362.2
4,106,615 A * 8/1978 Hiroshi ..... B65D 5/4204 206/362.2
(Continued)

FOREIGN PATENT DOCUMENTS

CN 2790947 6/2006
CN 201634065 11/2010
(Continued)

OTHER PUBLICATIONS

Patent Translate Powered by EPO and Google for JP2015044618A, 10 pages.*
(Continued)

*Primary Examiner* — Luan K Bui

(57) ABSTRACT

A packaged oral care implement that includes a package and at least one oral care implement. The package may include a blister package having a receiving cavity and a flat panel coupled to the blister package to close an open end of the receiving cavity. The flat panel may include a first window aperture. A transparent film may be placed onto a front surface of the flat panel to cover or otherwise close the first window aperture.

19 Claims, 8 Drawing Sheets

(58) Field of Classification Search
USPC ..... 206/361, 362, 362.1–362.3, 461, 471, 206/776–778, 782; 132/308
See application file for complete search history.

(56) References Cited

U.S. PATENT DOCUMENTS

| | | | | |
|---|---|---|---|---|
| 5,240,110 | A | 8/1993 | Reichenbach, III et al. | |
| 6,889,829 | B2 | 5/2005 | Ferber et al. | |
| 6,945,397 | B2 | 9/2005 | Brattesani et al. | |
| 7,094,981 | B2 * | 8/2006 | Sorrentino | A61C 17/225 200/332.2 |
| 7,213,709 | B2 | 5/2007 | Moskovich et al. | |
| 8,177,066 | B2 | 5/2012 | Tilton | |
| D704,548 | S | 5/2014 | Demar et al. | |
| 9,016,471 | B2 * | 4/2015 | Jimenez | A46B 15/0085 206/362.2 |
| 9,731,882 | B2 | 8/2017 | Lee | |
| 9,980,798 | B2 * | 5/2018 | Moskovich | A61C 19/02 |
| 2003/0116459 | A1 * | 6/2003 | Sarkar | B65D 75/36 206/362.1 |
| 2009/0307859 | A1 | 12/2009 | Dickie | |
| 2013/0256165 | A1 * | 10/2013 | Moskovich | B65D 73/0092 206/459.5 |
| 2013/0276815 | A1 * | 10/2013 | Hohlbein | A46B 15/0055 132/308 |
| 2014/0083885 | A1 * | 3/2014 | Lee | B65D 75/366 206/361 |
| 2014/0339111 | A1 * | 11/2014 | Moskovich | B65D 75/324 206/362.3 |

FOREIGN PATENT DOCUMENTS

| | | |
|---|---|---|
| CN | 103561710 | 2/2014 |
| CN | 107848682 | 3/2018 |
| EP | 3124398 | 2/2017 |
| JP | 2003-040330 | 2/2003 |
| JP | 2015-044618 | 3/2015 |
| KR | 2020080004746 U | 10/2008 |
| KR | 20180057376 | 5/2018 |

OTHER PUBLICATIONS

International Search Report and the Written Opinion of the International Searching Authority issued in International Application PCT/US2019/045702 dated Nov. 4, 2019.

* cited by examiner

PACKAGED ORAL CARE IMPLEMENT AND PACKAGED SET THEREOF

BACKGROUND OF THE INVENTION

In the commercialization of toothbrushes, the current trend is to package toothbrushes in blister packages. White the use of blister packages has proven to be cost-effective and effective at adequately protecting the toothbrush contained therein, existing blister packages are often difficult to open. Furthermore, toothbrushes may also be packaged in blister packs whereby the cavity of the blister pack is closed by a backer card. As a result, the toothbrushes are only visible from one side because the backer card tends to be opaque. However, it may be desirable for a consumer to be able to view both sides of the toothbrush before deciding whether to make a purchase. Thus, a need exists for an improved package that cures one or more of the aforementioned deficiencies.

BRIEF SUMMARY OF THE INVENTION

The present invention is directed to a packaged oral care implement that includes a package and at least one oral care implement. The package may include a blister package having a receiving cavity and a flat panel coupled to the blister packaged to close an open end of the receiving cavity. The flat panel may include a first window aperture. A transparent film may be placed onto a front surface of the flat panel to cover or otherwise close the first window aperture.

In one embodiment, the invention may be a packaged oral care implement comprising: a package having a front surface and an opposite rear surface, the package comprising: a blister package comprising a receiving cavity having an open rear end; a flat panel comprising a front surface, a rear surface opposite the front surface, and a first window aperture formed through the flat panel, the flat panel coupled to the blister package so that the rear surface of the flat panel closes the open rear end of the receiving cavity; and a transparent film coupled to the front surface of the flat panel and covering the first window aperture; and an oral care implement positioned within the receiving cavity of the blister package, wherein the oral care implement is visible from the rear surface of the package through the blister package and from the front surface of the package through the first window aperture.

In another embodiment, the invention may be a packaged set of oral care implements comprising: a package having a front surface and an opposite rear surface, the package comprising: a blister package comprising one or more receiving cavities each having an open rear end; a flat panel coupled to the blister package so that a rear surface of the flat panel closes the open rear end of each of the one or more receiving cavities, the flat panel comprising a plurality of pre-weakened areas that divide the flat panel into a plurality of sections such that each of the plurality of sections is aligned with one of the one or more receiving cavities, wherein each of the plurality of sections comprises a first window aperture; a transparent film coupled to a front surface of the flat panel that is opposite the rear surface of the flat panel, the transparent film covering the first window aperture, wherein the transparent film is non-heat sealable; and a plurality of oral care implements positioned between the blister pack and the flat panel so that each of the plurality of oral care implements is positioned within one of the plurality of receiving cavities, wherein each of the oral care implements is visible from the rear surface of the package through the blister package and from the front surface of the package through the first and window aperture.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

Figure 1:
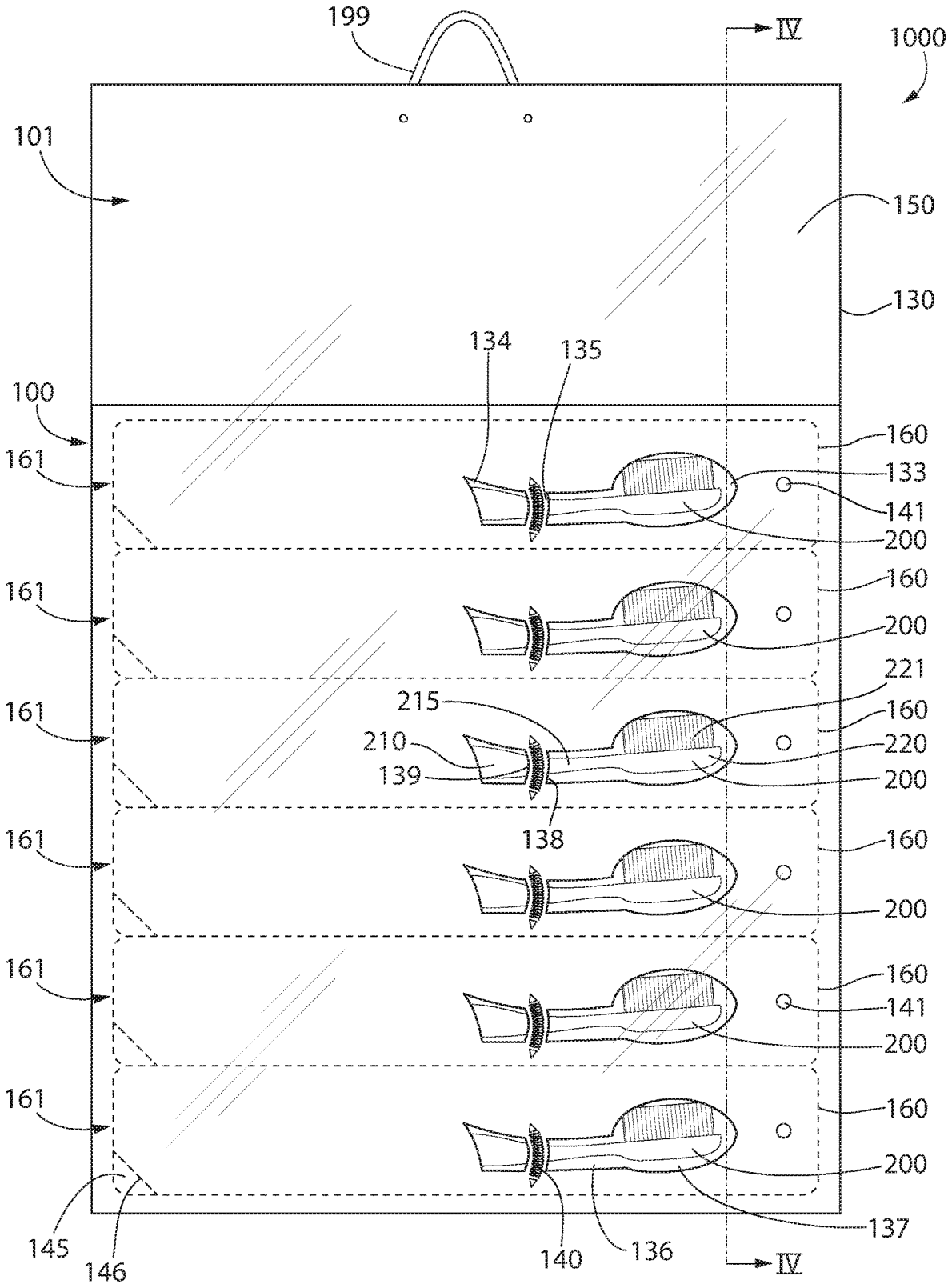
FIG. 1 is a front view of a packaged set of oral care implements in accordance with an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Figure 2:
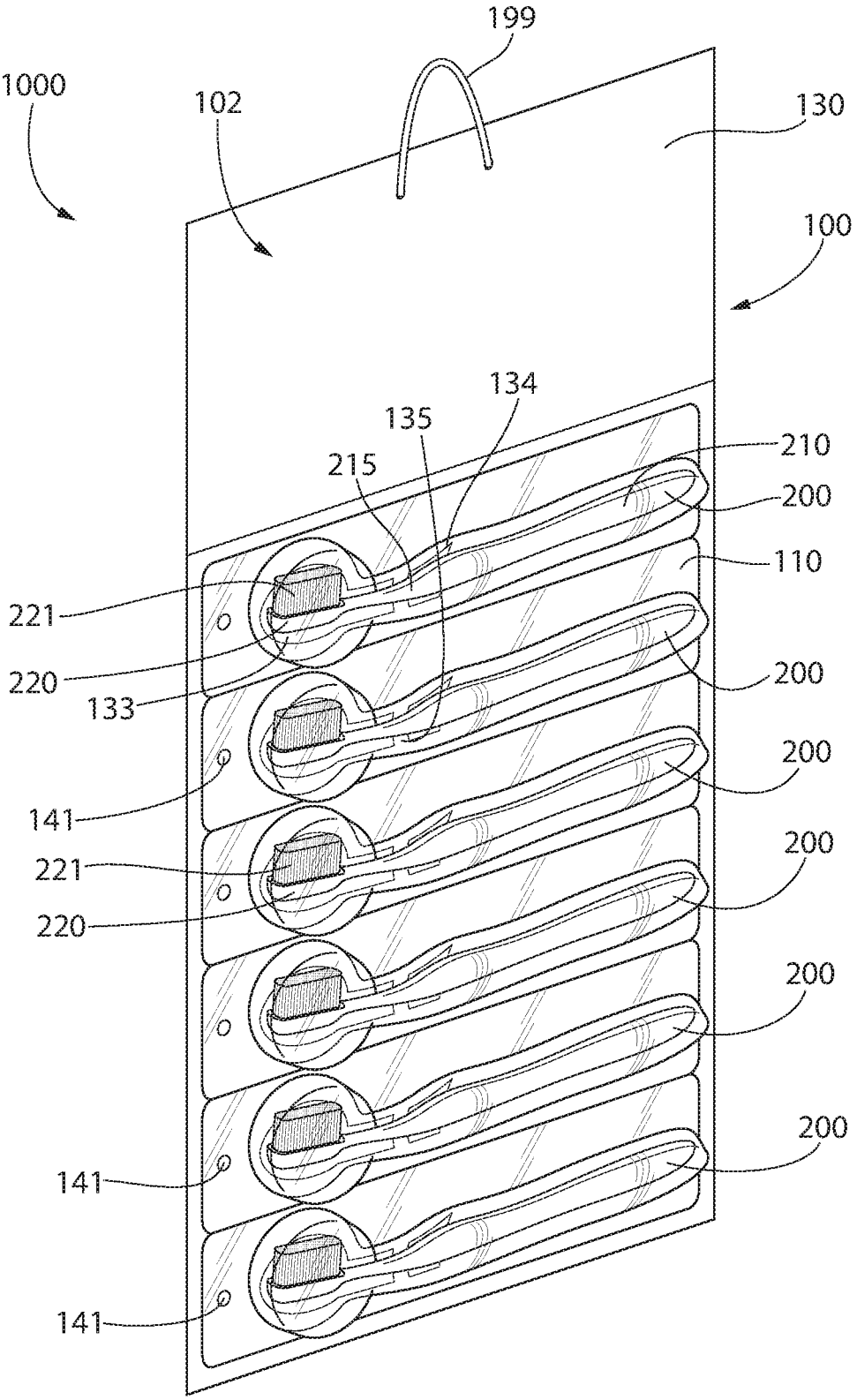
FIG. 2 is a rear perspective view of the packaged set of oral care implements of FIG. 1.
Figure 3:
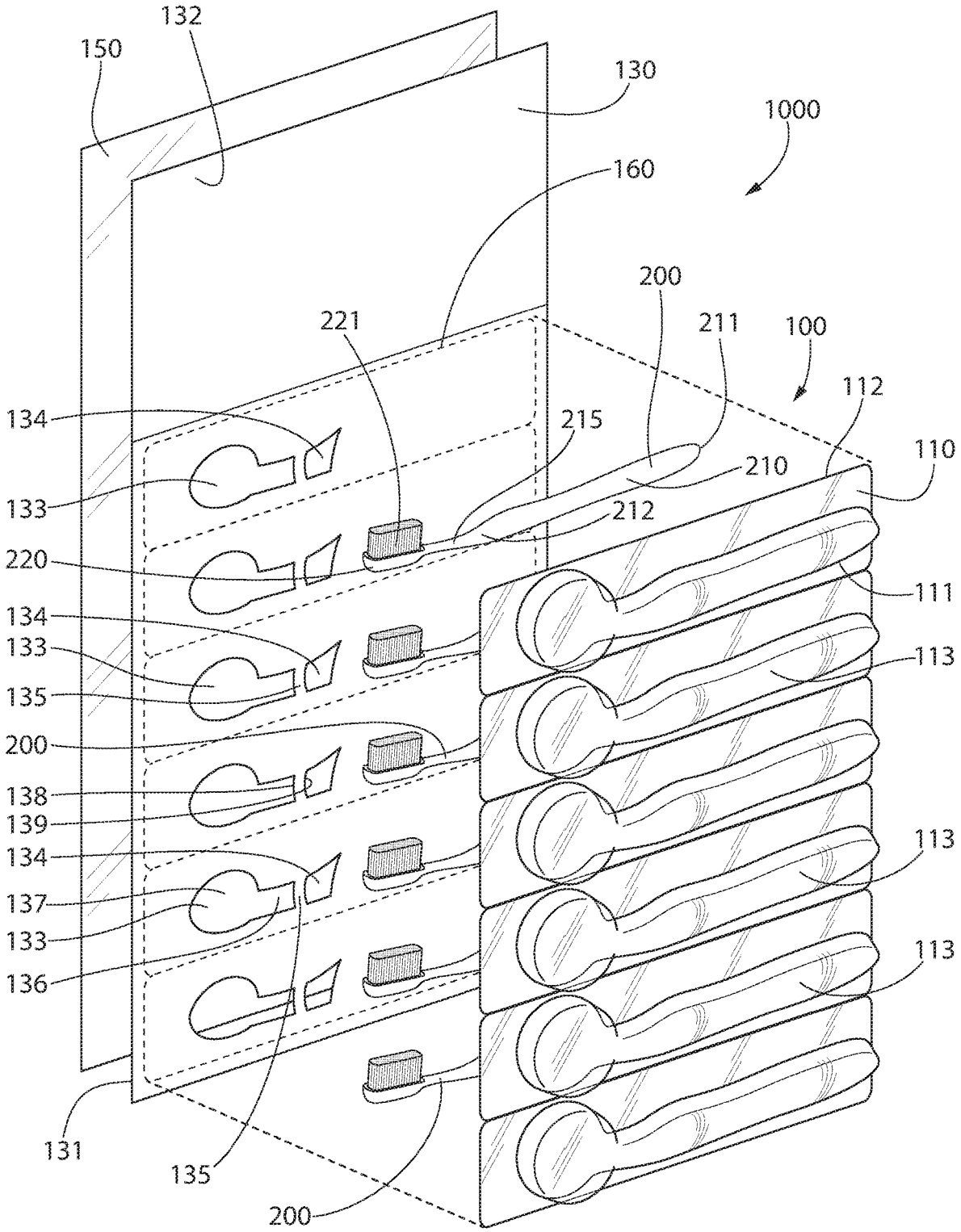
FIG. 3 is an exploded rear perspective view of the packaged set of oral care implements of FIG. 1.
Figure 4:
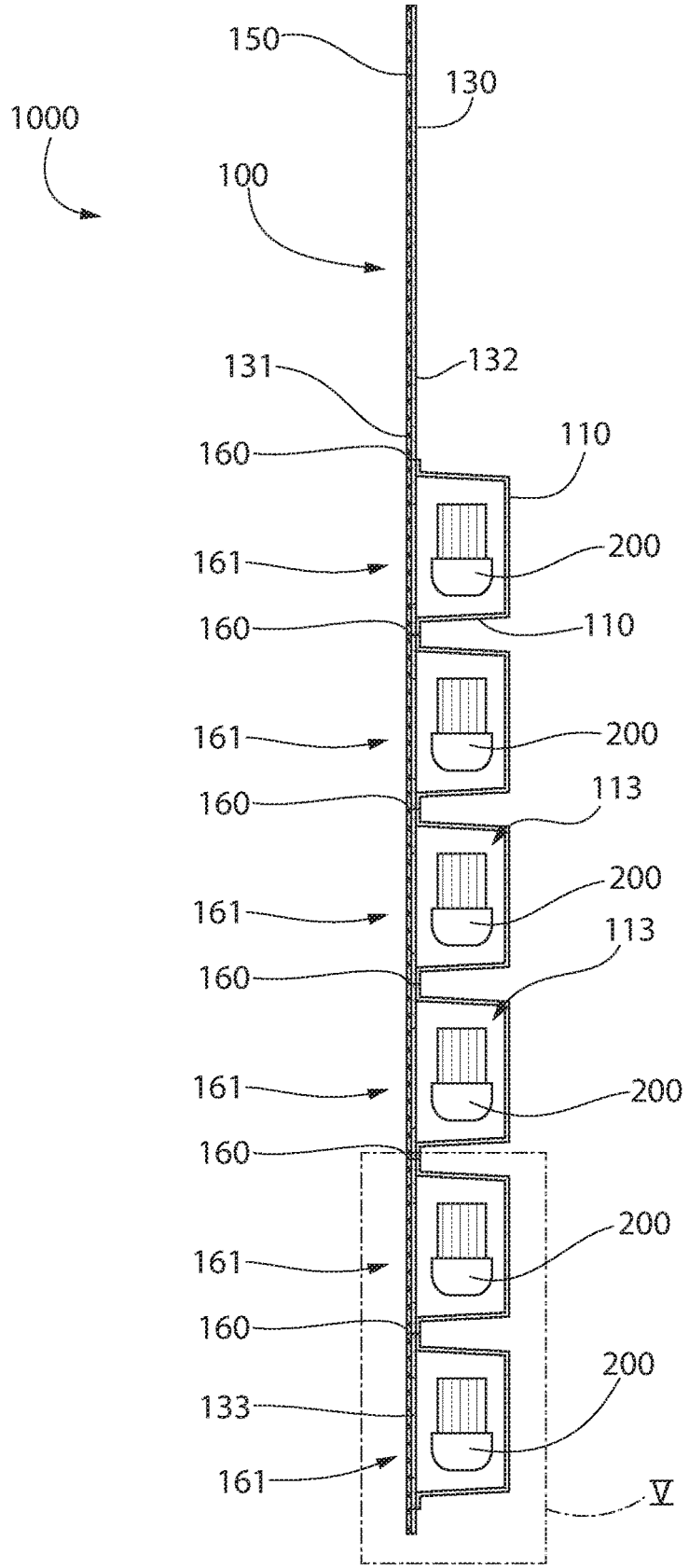
FIG. 4 is a cross-sectional view taken along line IV-IV of FIG. 1.
Figure 5:
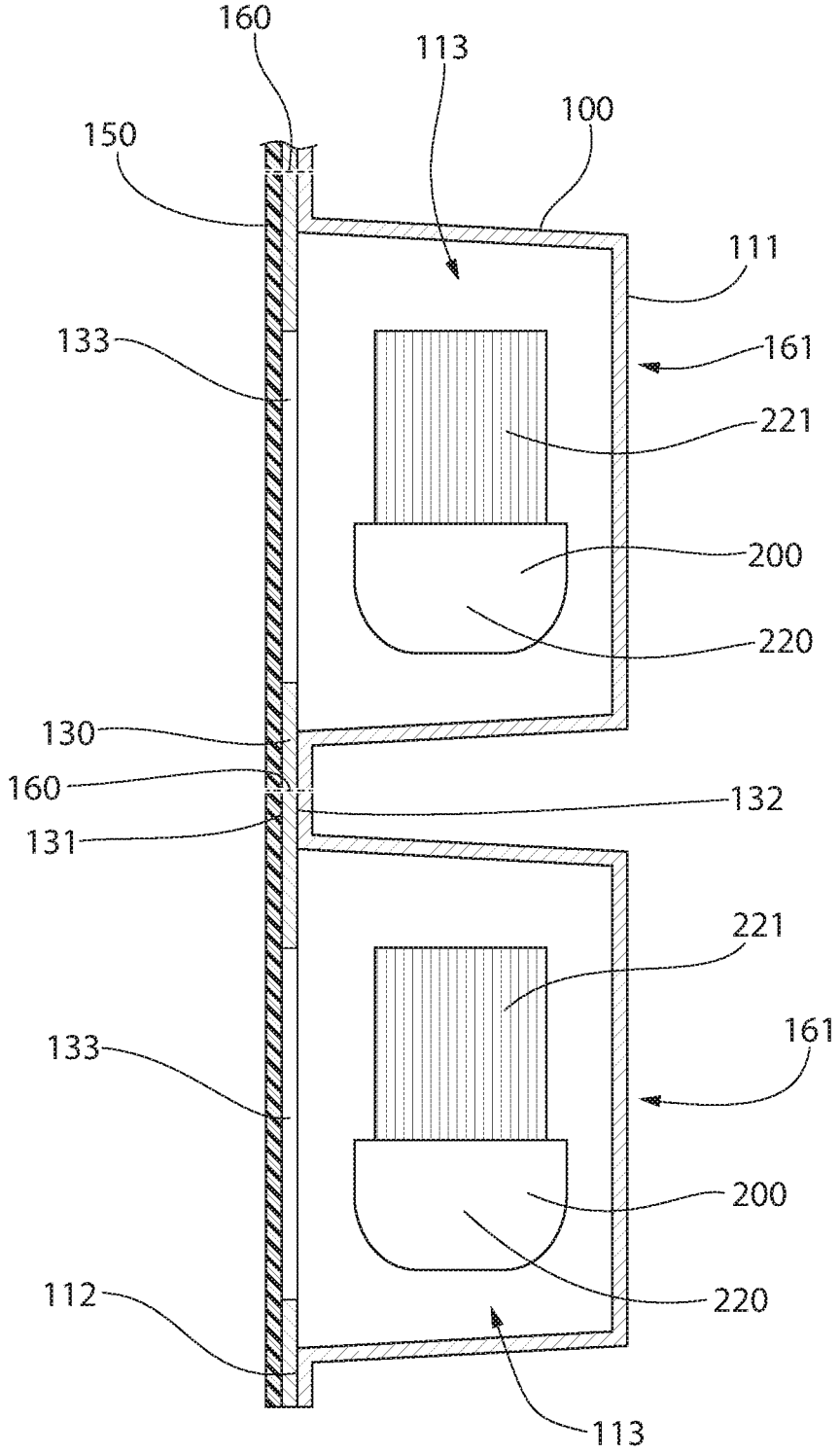
FIG. 5 is a close-up view of area V of FIG. 4.

Referring to FIGS. 1-2 concurrently, a packaged set of oral care implements 1000 is illustrated according to an embodiment of the present invention. The packaged set of oral care implements 1000 generally comprises a package 100 and a plurality of oral care implements 200 that are positioned within and retained by the package 100. The package 100 protects the oral care implement 200 from damage during transit from the manufacturing facility to the retail store or the consumer's home. The package 100 also enables a potential consumer to view the oral care implement 200 through the package 100 when the consumer is trying to determine whether or not to make a purchase.

Although in the exemplified embodiment the package 100 contains a plurality of the oral care implements 200, in other embodiments the package 100 may contain only one of the oral care implements 200. Thus, the invention may be directed to only a portion or section of the packaged set of oral care implements 1000 illustrated in FIG. 1 that is sufficient to hold or otherwise contain a single one of the oral care implements 200. For example, the portion or section of the packaged set of oral care implements 1000 that is being detached from the remainder of the packaged set of oral care implements 1000 in FIG. 6 could form the packaged oral care implement in some embodiments.

In the exemplified embodiment, the oral care implement 200 is a toothbrush, and more specifically a manual toothbrush. Of course, in other embodiments the oral care implement 200 may be a powered toothbrush. In still other embodiments, other types of oral care implements can be used in conjunction with the package 100, including tongue cleaners, tooth polishers, oral care material dispensers, and other oral care ansate implements. Finally, in certain other embodiments, the invention can be the package 100 independent of the product contained therein.

Moreover although in the exemplified embodiment the package 100 is intended to contain one or more oral care implements 200, the invention is not to be so limited in all embodiments. Specifically, in other embodiments the package 100 may contain, for example, an oral care implement and a container of toothpaste. Alternatively, the package 100 may contain oral care implements plus any other articles such as pencils, pens, hygiene caps, or the like. Moreover, although in the exemplified embodiment each of the oral care implements 200 is positioned within its own receiving cavity, in other embodiments multiple oral care implements 200 may be disposed in a single cavity.

The package 100 generally comprises a front surface 101 and a rear surface 102 that is opposite the front surface 101. The front surface 101 of the package 100 is flat or planar whereas at least a portion of the rear surface 102 of the package 1000 has a three-dimensional contour. The oral care implements 200 are exposed on both of the front and rear surfaces 101, 102 of the package 100. However, a greater amount/percentage of the oral care implements 100 are exposed when viewed from the rear surface 102 of the package 100 than from the front surface 101 of the package 100. In the exemplified embodiment, an entirety of the oral care implements 100 are visible when viewed from the rear surface 102 of the package 100 whereas only a portion of the oral care implements 200 are visible when viewed from the front surface 101 of the package 100.

Referring to FIGS. 1-5 concurrently, the package 100 generally comprises a blister package 110, a flat panel 130, and a transparent film 150. These components of the package 100 are coupled together in such a manner that they can hold the plurality of oral care implements 200 for display in a retail environment while permitting the oral care implement 200 to be viewed by a consumer. Thus, the package 100 protects the oral care implements 200 during transit and display, but the package 100 does not affect a consumer's ability to view the product prior to purchase. In the exemplified embodiment, there are six of the oral care implements 200 positioned within the package 100, although more or less than six of the oral care implements 200 may be positioned in the package 100 in other embodiments. In some embodiments, the package 100 is sold as a unit with all of the oral care implements 200.

In other embodiments, the package 100 includes tear-away portions so that each of the oral care implements 200 can be purchased separately at the point of sale by detaching portions of the package from a remainder of the package, as described in more detail below. Thus, in the exemplified embodiment the package 100 is what is known in the art as a hanger mat, which is a single package containing multiple articles whereby the articles can be individually detached or removed from the package while remaining enclosed within an individual package. Thus, the individual packages make up the whole package 100, but each individual package is detachable from the whole package 100.

The plurality of oral care implements 200 are housed within the package 100 as described herein. Each of the oral care implements 200 comprises a handle 210, a head 220, and a neck 215 that extends between the handle 210 and the head 220. Specifically, the handle 210 extends from a distal end 211 to a proximal end 212, the neck 215 is coupled to and extends from the proximal end 212 of the handle 210, and the head 220 is coupled to and extends from the neck 215 on the opposite end of the neck 215 from the handle 210.

A plurality of tooth cleaning elements 221 extend from a front surface of the head 220 for cleaning a user's oral cavity. The plurality of tooth cleaning elements 221 may comprise bristles formed of nylon that may be end-rounded, tapered, and/or spiral, lamella or other wiper-style cleaning elements that are formed from a thermoplastic elastomer or rubber, or any other element that is typically used for the cleaning of a user's teeth, gums, and/or tongue. Common examples of tooth cleaning elements include, without limitation, bristle tufts, filament bristles, fiber bristles, nylon bristles, spiral bristles, rubber bristles, elastomeric protrusions, flexible polymer protrusions, combinations thereof and/or structures containing such materials or combinations. Suitable elastomeric materials include any biocompatible resilient material suitable for uses in an oral hygiene apparatus. To provide optimum comfort as well as cleaning benefits, elastomeric material that may be used to form lamella preferably has a hardness property in the range of A8 to A25 Shore hardness. One preferred elastomeric material is styrene-ethylene/butylene-styrene block copolymer (SEBS) manufactured by GLS Corporation. Nevertheless, SEBS material from other manufacturers or other materials within and outside the noted hardness range can be used. The tooth cleaning elements 221 may be coupled to the head 220 in any conventional manner.

In the exemplified embodiment, the oral care implements 200 positioned in the package 100 are identical to one another. Thus, the package 100 holds six identical oral care implements 200. However, the invention is not to be so limited and the package 100 may contain several different oral care implements 200 with different shapes, structures, bristle patterns, or the like.

As noted throughout, when the packaged set of oral care implements 1000 is assembled for retail display (as shown in FIGS. 1 and 2), at least a portion of the oral care implements 200 contained in the package 100 are visible from outside of the package 100 from both the front of the package 100 and the rear of the package 100. As a result, surfaces of the portion of the oral care implement 200 that are substantially opposite one another (i.e., 180° apart) can be viewed by the consumer without removing the oral care implement 200 from the package 100 or compromising the integrity of the package 100.

As noted above, the package 100 comprises the blister package 110, the flat panel 130, and the transparent film 150, each of which will be described in some detail herein below. In the exemplified embodiment, the flat panel 130 is formed of the same material as a typical backer card. For example, the flat panel 130 may be formed from a paperboard material, cardboard, or the like. In one exemplary embodiment, the flat panel 110 is formed from 270-320 grams per square meter (GSM) paperboard made from recycled or virgin material. In the invention described herein the flat panel 130 forms a front of the package 100 rather than a rear of the package 100 as with traditional backer cards.

The flat panel 130 generally comprises a front surface 131 and a rear surface 132 opposite the front surface 131. Each of the front and rear surfaces 131, 132 of the flat panel 130 are flat, planar surfaces. In the exemplified embodiment, the front and rear surfaces 131, 132 of the flat panel 130 are parallel to one another. The flat panel 130 may include product information, marketing information, instructions, other relevant information, graphics, logos, and/or other visual designs printed or otherwise provided thereon. All or a portion of the flat panel 130 can be opaque so that product information can be effectively conveyed to the consumer. In some embodiments, such markings or printing may be provided on the front surface 131 of the flat panel 130 whereas in other embodiments such markings or printing may be provided on the rear surface 132 of the flat panel 130. In other embodiments still, both of the front and rear surfaces 131, 132 of the flat panel 130 may include markings, printings, or the like thereon to provide information about the product contained in the package 100 to a consumer. While the flat panel 130 may be flexible in certain embodiments, in other embodiments the flat panel 130 may be rigid or semi-rigid.

The blister package 110 is coupled to the rear surface 132 of the flat panel 130. The blister package 110 may be a thermoformed plastic film having a three-dimensional contour that enables the blister package 100 to house the oral care implements 200. Suitable thermoformed plastic films may be constructed of such material as polyethyleneterephtalate (PETA, PETG, PETGAG), polyvinylchloride (PVC), polypropylene (PP) or styrol-butadiene-blockcopolymer (SBS), recycled polyethylene terephthalate (RPET), with PCT or RPET being preferred in some embodiments. Other suitable materials of construction for the thermoformed plastic film include, without limitation, renewable primary products, for example of cornstarch, sugar (polyhydroxybutyrat/-valerat), cellulose diacetat, cellulose nitrate, polyactid (PLA), and polyhydroxybutyrat (PHB).

In the exemplified embodiment, the blister package 100 is substantially transparent, thereby allowing visibility therethrough. However, in alternate embodiments, only a portion of the blister package 100 may be substantially transparent. As used herein, the term "transparent" includes materials that allow a user to see through the material, even if the material is colored or includes a small degree of translucency.

The blister package 110 has a front surface 111 and a rear surface 112 opposite the front surface 111. When coupled to the flat panel 130, the rear surface 112 of the blister package 110 is adjacent to the rear surface 132 of the flat panel 130. Furthermore, a perimeter portion of the blister package 110 may be heat-sealed or otherwise affixed (using an adhesive or the like) to the rear surface 132 of the flat panel 130 to couple the blister package 110 to the flat panel 130.

The blister package 110 comprises or defines a plurality of receiving cavities 113. In the exemplified embodiment, the blister package 110 is an integral, monolithic structure that forms or defines all of the plurality of receiving cavities 113. In alternative embodiments, the blister package 110 may comprise a plurality of blister sections that are separately formed from one another and each coupled to the flat panel 130. In such an embodiment, each of the blister sections may comprises one of the plurality of receiving cavities 113. Each of the plurality of receiving cavities 113 has an open rear end in the rear surface 112 of the blister package 110 to facilitate placing the oral care implements 200 into and removing the oral care implements 200 from the receiving cavities 113. During assembly of the packaged set of oral care implements 1000, the oral care implements 200 are placed within the receiving cavities 113 of the blister package 110 through the open rear end and then the blister package 110 is coupled to the rear surface 132 of the flat panel 130 (using heat sealing, adhesive bonding, or the like). As a result, the oral care implements 200 are disposed within the receiving cavity 113 between the blister packages 110 and the flat panel 130.

The transparent film 150 is coupled to the front surface 131 of the flat panel 130. The transparent film 150 may be a non-heat sealable laminate film. In some embodiments, the transparent film 150 may be formed from biaxially oriented polypropylene (BOPP), recycled polyethylene terephthalate (RPET), or polyvinyl chloride (PVC). In some embodiments the transparent film 150 may have a thickness between 10 and 70 microns, more specifically between 10 and 50 microns, more specifically between 10 and 30 microns, and still more specifically between 15 and 25 microns. In certain embodiments, the transparent film 150 is affixed to the front surface 131 of the flat panel 130 using an adhesive. Although adhesive is used in the exemplified embodiment, in other embodiments the transparent film 150 may be coupled to the flat panel 130 using fasteners, staples, screws, nails, other hardware components, hook-and-loop strips, or the like. Such mechanisms may be necessary in some embodiment when the transparent film 150 is non-heat sealable. However, it is possible that in other embodiments the transparent film 150 may be capable of being heat-sealed to the flat panel 130. In the exemplified embodiment, the transparent film 150 covers an entirety of the front surface 131 of the flat panel 130. Thus, the transparent film 150 forms an entirety of the front surface 101 of the package 100. It is possible in other embodiments for the transparent film 150 to be located only along certain portions of the flat panel 130 rather than covering it in its entirety. As will be described in more detail below, the transparent film 150 covers apertures in the flat panel 130 to form windows through which the oral care implements 200 can be viewed.

As noted above, in the exemplified embodiment the package 100 is intended to house a plurality of the oral care implements 200. In that regard, in the exemplified embodiment the package 100 comprises a plurality of pre-weakened areas 160 that divide the package 100 into a plurality of sections 161. The pre-weakened areas 160 extend through the entirety of the package 100, including through the blister package 110, the flat panel 130, and the transparent film 150. Thus, a user can readily detach a section 161 of the package 100 from the remainder of the package 100, which includes detaching a section of the blister package 110, the flat panel 130, and the transparent film 150 while keeping the section of the blister package 110, the flat panel 130, and the transparent film 150 being detached intact. Thus, even after being detached, the oral care implement 200 in that particular section 161 remains positioned within the receiving cavity 113 and disposed between the blister package 110 and the flat panel 130. Thus, the detached section 161 still offers protection to the oral care implement 200 against damage and bacteria until it is opened by a consumer as described below with reference to FIGS. 7 and 8. In the exemplified embodiment, the pre-weakened areas 160 may be formed by perforation lines, score lines, small holes, a deep depression, or the like.

Figure 9:
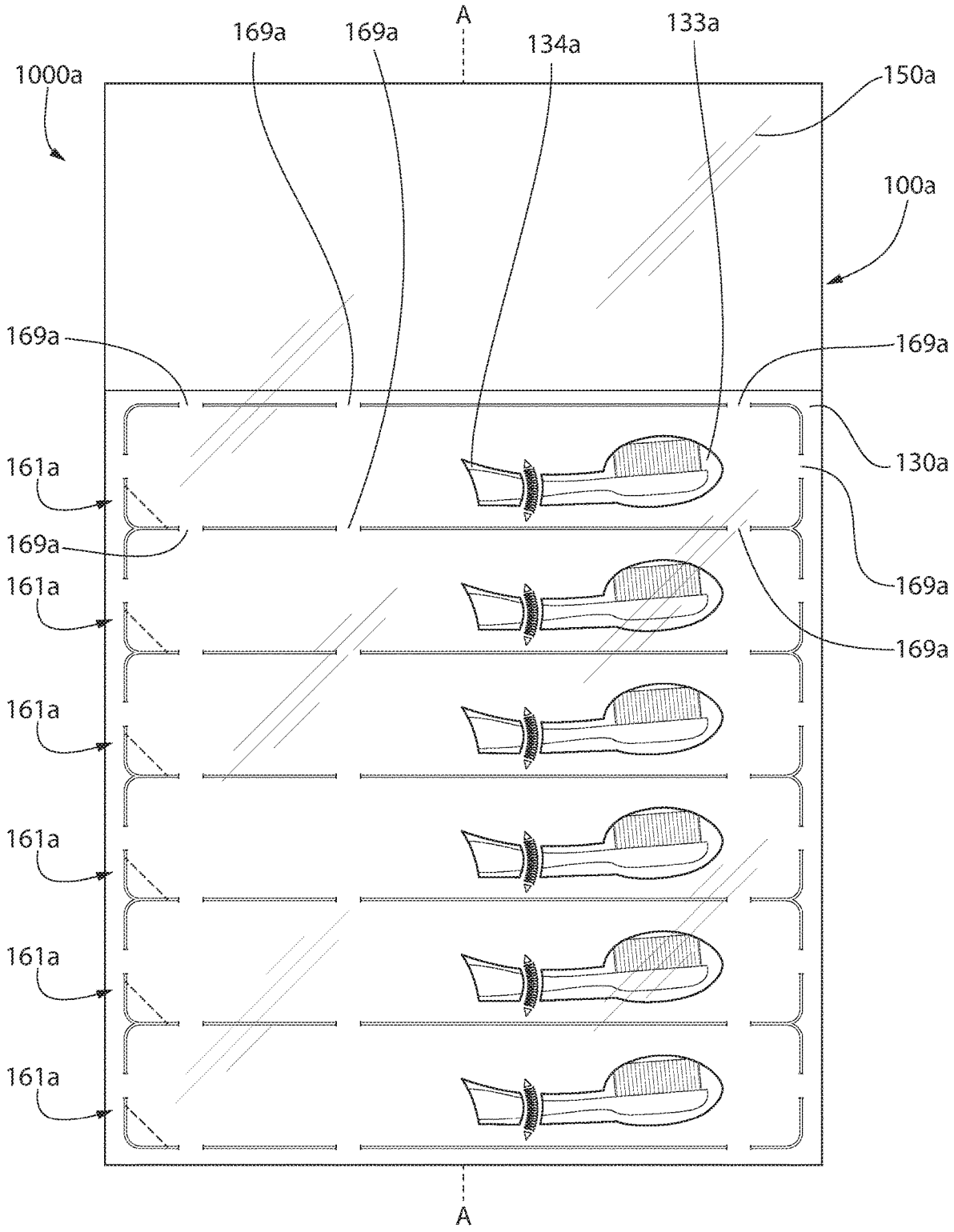
FIG. 9 is a front view of a packaged set of oral care implements in accordance with an alternative embodiment of the present invention.

With a brief reference to FIG. 9, an alternative embodiment of a packaged set of oral care implements 1000*a* is illustrated to describe an alternative embodiment for the pre-weakened areas 160*a*. The packaged set of oral care implements 1000*a* will be numbered similarly to the packaged set of oral care implements 1000 except that the suffix "a" will be used. Thus, the description fo the packaged set of oral care implements 1000 is applicable to the packaged set of oral care implements 1000*a* unless a contradictory description is provided in the description of FIG. 9.

In the embodiment of the packaged set of oral care implements 1000*a* illustrated in FIG. 9, each section 161*a* of the package 100*a* may be coupled to the adjacent sections 161*a* at discrete attachment points 169*a* (also referred to as "notches"), with the remainder of the adjacent sections 161*a* not being physically attached. Some but not all of the attachment points 169*a* are labeled in the drawings to avoid clutter and redundancy. Thus, in this embodiment the adjacent sections 161 are only attached at small, discrete, spaced apart regions, thereby rendering detachment of the adjacent sections 161 from one another easy to achieve. In some embodiments, the discrete attachment points 169*a* may be between 0.5 and 2.0 mm in length, and more specifically between 1.0 and 1.5 mm in length. In one preferable embodiment, the discrete attachment points may be 1.0 mm in length. There is no physical attachment between the adjacent sections 161 in between the discrete attachment points 169*a*.

As will be described in greater detail below with regard to the main embodiment, the package 100*a* comprises a first window aperture 133*a* and a second window aperture 134*a*, which are apertures formed through the flat panel 130*a* that are covered by the transparent film 150*a*. In the exemplified embodiment, none of the discrete attachment points 169*a* are aligned with either of the first and second window apertures 133*a*, 134*a*. Stated another way, the package 100*a* extends along a longitudinal axis A-A. Any plane that is parallel to the longitudinal axis A-A and that extends through the front and rear surfaces of the package 100*a* that intersects either of the first and second window apertures 133*a*, 134*a* does not also intersect any one of the notches 169*a*. As a result of this, none of the discrete attachment points 169*a* are aligned with the longitudinal axis A-A, and thus the longitudinal axis A-A of the package 100*a* does not intersect any of the notches 169*a*. Thus, the discrete attachment points 169*a* are off-centered and are not provided in the region of the first and second window apertures 133*a*, 134*a*. This protects the integrity of the seal into the receiving cavities as aligning the discrete attachment points 169*a* with the first and/or second window apertures 133*a*, 134*a* creates a situation where the transparent film 150 may rip or tear along the first and second window apertures 133*a*, 134*a*.

The exact structure that creates the pre-weakened areas 160 is not to be limiting of the invention in all embodiments so long as the pre-weakened areas 160 enable sections of the package 100 to be detached from the remainder of the package 100 as described herein. Furthermore, in some embodiments the pre-weakened areas 160 may be omitted such that detaching sections of the package 100 may not be possible or may at least not be facilitated by the structure of the package 100.

Each of the sections 161 of the package 100 includes a portion of the blister package 110, a portion of the flat panel 130, and a portion of the transparent film 150. Furthermore, each of the sections 161 comprises one of the receiving cavities 113 so that each of the sections 161 of the package 100 can hold or otherwise contain one of the oral care implements 200. Stated another way, one of the oral care implements 200 is positioned within the receiving cavity 113 of each of the sections 161 of the package 100. Thus, detaching one of the sections 161 from the remainder of the package 100 will detach one of the oral care implements 200 so that it can be purchased or used separately from the others of the oral care implements 200 of the packaged set of oral care implements 1000.

In the exemplified embodiment, the flat panel 130 comprises a first window aperture 133 and a second window aperture 134 within each of the sections 161 of the package 100. Thus, one of the first window apertures 133 and one of the second window apertures 134 is aligned with each of the receiving cavities 113 of the blister package 110. As a result, portions of each of the oral care implements 200 (one of which is positioned within each of the receiving cavities 113) can be seen from a front of the package 100 through each of the first and second window apertures 133, 134. The package 100 has a longitudinal axis that extends transverse to an axis of the oral care implements 200, the longitudinal axis of the package 100 dividing the package into a first section and a second section. In the exemplified embodiment, both of the first and second window apertures 133, 134 are located within the first section of the package 100. Stated another way, both of the first and second window apertures 133, 134 are located on the same side of the longitudinal axis of the package 100 (although a small part of the second window aperture 134 may extend onto the second side of the longitudinal axis of the package 100 in some embodiments). Thus, the first and second window apertures 133, 134 allow a consumer to view upper portions of the oral care implement 200 but not lower portions of the oral care implement 200 from the front surface 101 of the package 100.

Each of the first and second window apertures 133, 134 extends through the flat panel 130 from the front surface 131 to the rear surface 132. The first and second window apertures 133, 134 are spaced apart such that they are separated by a bridge portion 135 of the flat panel 130. In the exemplified embodiment, the oral care implements 200 extend along a longitudinal axis and the bridge portions 135 are elongated in a direction that is transverse to the longitudinal axis of the oral care implements 200. In the exemplified embodiment, the bridge portions 135 are arcuate. Moreover, the arcuate shape of the bridge portions 135 match or otherwise correspond to the direction of movement of the head/neck 215, 220 of the oral care implement 200 that occurs when a force is applied to the head 220.

Specifically, the arc-like movement of the head 220 when under pressure is similar to the arc-like shape of the bridge portion 135.

The surface area of the first window aperture 133 is larger than the surface area of the second window aperture 134 in the exemplified embodiment. The space between the first and second window apertures 133, 134 (i.e., the surface area of the bridge portion 135) is small relative to the overall length of the oral care implement 100. Thus, the surface area of the bridge portion 135 is less than the surface area of each of the first and second window apertures 133, 134. As a result, the first and second window apertures 133, 134 are reasonably close together such that at first glance an observer may not notice that there are two distinct window apertures. The bridge portion 135 covers/conceals from view an axial portion of the oral care implement 200 that is between the proximal portion of the handle 210 that is visible through the second window aperture 134 and the portion of the neck and head 215, 220 that are visible through the first window aperture 133.

As described above, the transparent film 150 covers the entirety of the front surface 131 of the flat panel 130, thereby covering or enclosing each of the first and second window apertures 133, 134 along the front surface 101 of the package 100. In other embodiments, the transparent film 150 may merely be coupled to the flat panel 130 so as to cover or enclose each of the first and second window apertures 133, 134 without requiting the transparent film 150 to cover the entirety of the front surface 131 of the flat panel 130. Thus, the transparent film 150 may merely span the first and second window openings 133, 134 without extending much beyond the first and second window openings 133, 134. However, covering the entire front surface 131 of the flat panel 130 with the transparent film 150 may create a more seamless and desirable aesthetic. There is no opening from the front surface 101 of the package 100 into the receiving cavities 113 because the first and second window apertures 133, 134 are closed by the transparent film 150. However, because the transparent film 150 is transparent, it does not block a user from viewing the oral care implements 200, or portions thereof, through the first and second window apertures 133, 134, as best shown in FIG. 1.

Each of the first window apertures 133 are identical in shape, appearance, and position on the particular section 161 of the package 100 on which they are located and each of the second window apertures 134 are identical in shape, appearance, and relative position on the particular section 161 of the package 100 on which they are located. Thus, although the specific details will be described with regard to one of the first window apertures 133 and one of the second window apertures 134, it should be appreciated that the descriptions apply to each of the first and each of the second window apertures 133, 134.

In the exemplified embodiment, the first window aperture 133 comprises a generally linear portion 136 and a bulbous potion 137. In the exemplified embodiment, the bulbous portion 137 is round, circular, or ovular in shape, but the invention is not to be so limited in all embodiments and the bulbous portion 137 could have a square, rectangular, or triangular shape in other embodiments. The bulbous portion 137 is sized, shaped, and positioned so that the head 220 and tooth cleaning elements 221 are visible therethrough when viewed from the front surface 101 of the package 100. The linear portion 136 is sized, shaped, and positioned so that a portion of the neck 215 of the oral care implement 200 is visible therethrough when viewed from the front surface 101 of the package 100. The second window aperture 134 is spaced apart from the first window aperture 133 by the bridge portion 135 of the flat panel 130. The second window aperture 134 has a generally trapezoidal shape. A proximal portion of the handle 210 of the oral care implement 200 that is adjacent to the neck 215 is visible through the second window aperture 134 when viewed from the front surface 101 of the package 100.

The bridge portion 135 extends between the first and second window apertures 133, 134 so that a portion of the oral care implement 200 located between the first and second window apertures 133, 134 is not visible from the front surface 101 of the package 100. The bridge portion 135 has a convex upper edge 138 that defines a lower end of the first window aperture 133 and a concave lower edge 139 that defines an upper end of the second window aperture 134. Thus, as noted above the bridge portion 135 is generally arcuate in shape. The lower end of the first window aperture 133 and the upper end of the second window aperture 134 are complementary in shape so that the lower end of the first window aperture 133 and the upper end of the second window aperture 134 would fit seamlessly together if the bridge portion 135 were removed.

The first and second window apertures 133, 134 and the bridge portion 135 of the flat panel 130 collectively have a shape that corresponds with a shape of an upper portion of the oral care implement 200. As best seen in FIGS. 1 and 2, an entirety of the oral care implement 200 is visible from the rear surface 102 of the package 100 through the blister package 130 and the head 220, the neck 215, and a portion of the handle 210 of the oral care implement 200 is visible from the front surface 101 of the package 100 through the transparent film 150 and the first and second window apertures 133, 134. The portion of the handle 210 may be less than one-half of a length of the handle 210, less than one-third of the length of the handle 210, less than one-fourth of the length of the handle 210, less than one-fifth of the length of the handle 210, less than one-sixth of the length of the handle 210, less than one seventh, one-eighth, one-ninth, or one-tenth of the length of the handle 210 in various different embodiments.

In the exemplified embodiment, the flat panel 130 comprises indicia 140 (illustrated in FIG. 1 only) on the front surface 131 along the bridge portion 135 that is indicative of a characteristic of the oral care implement 200 contained in the package 100. In the exemplified embodiment, the indicia 140 is an illustration of a spring with arrows to indicate that the oral care implement 200 is flexible. In certain embodiments, the bridge portion 135, and hence also the indicia 140 thereon, may be located in alignment with a pivot point of the oral care implement 200 about which the head 220 flexes/pivots when pressure is applied to the head 220 during brushing. Thus, the indicia 140 may not only indicate that the oral care implement 200 has flexibility, but also provide an indication of the exact location at which the head 220 pivots/flexes during use. Of course, the spring is just one specific indicium that may be used. The indicia 140 on the bridge portion 135 of the flat panel 130 may be modified to indicate different characteristics of the oral care implement 200, such as a tapering or spiral filament to indicate that the oral care implement 200 has tapered or spiral bristles, a snowflake or the like to indicate that the oral care implement 200 includes an additive that provides a cooling sensation (trigeminal response) to a user during use, or the like. The specific symbol or illustration used for the indicia 140 is not limiting of the present invention and can be modified as needed depending on the characteristics of the oral care implement 200 that is contained in the package 100 and desired to be informatively relayed to a consumer In the exemplified embodiment, the package 100 includes a hanging element 199 for hanging the packaged set of oral care implements 1000 in a retail environment. In the exemplified embodiment, the hanging element 199 is a strip of plastic or similar material that is coupled to the package 100. In other embodiments, the hanging element 199 could merely be an aperture or opening so that the package 100 can be hung from a hook. Thus, variations in the exact configuration of the hanging element 199 are possible within the scope of the invention described herein.

Furthermore, as shown in FIG. 1, in the exemplified embodiment there is a hanging aperture 141 formed through the package 100 within each of the sections 161 of the package 100. Thus, a retail store employee could detach each of the sections 161 of the package 100 and hang them separately if so desired rather than hanging the entire packaged set of oral care implements 1000 together as a single unit. When the packaged set of oral care implements 1000 is hanging for display, the front surface 131 of the flat panel 130 (which is covered by the transparent film 150) forms a display side of the package 100 that is exposed to a consumer. The rear surface 132 of the flat panel 130 is generally obscured from a consumer's view unless the consumer manipulates the packaged set of oral care implements 1000 and/or removes it from its hanging position.

Figure 6:
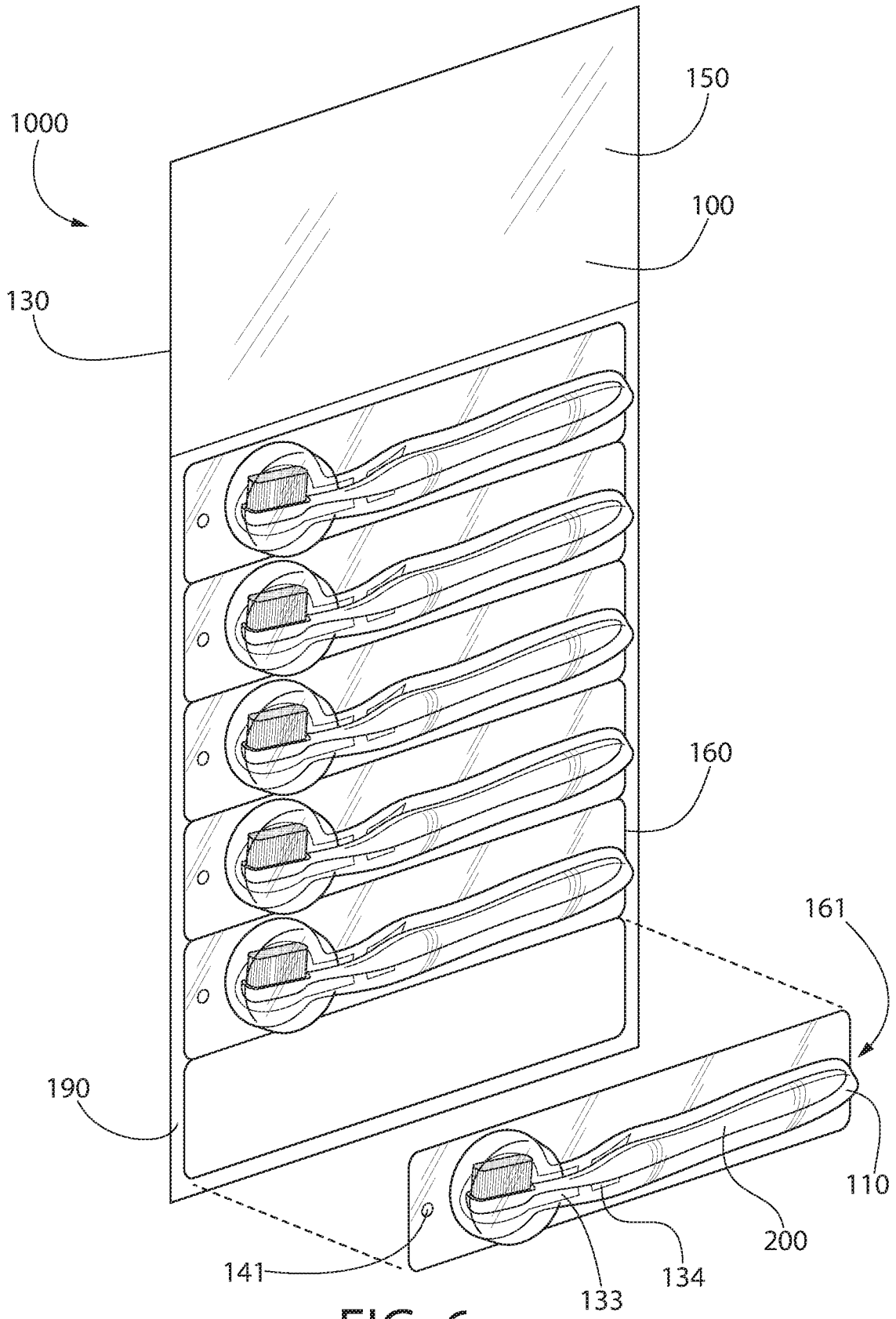
FIG. 6 is a perspective view illustrating a section of the packaged set of oral care implements being detached from a remainder of the packaged set of oral care implements.
Figure 7:
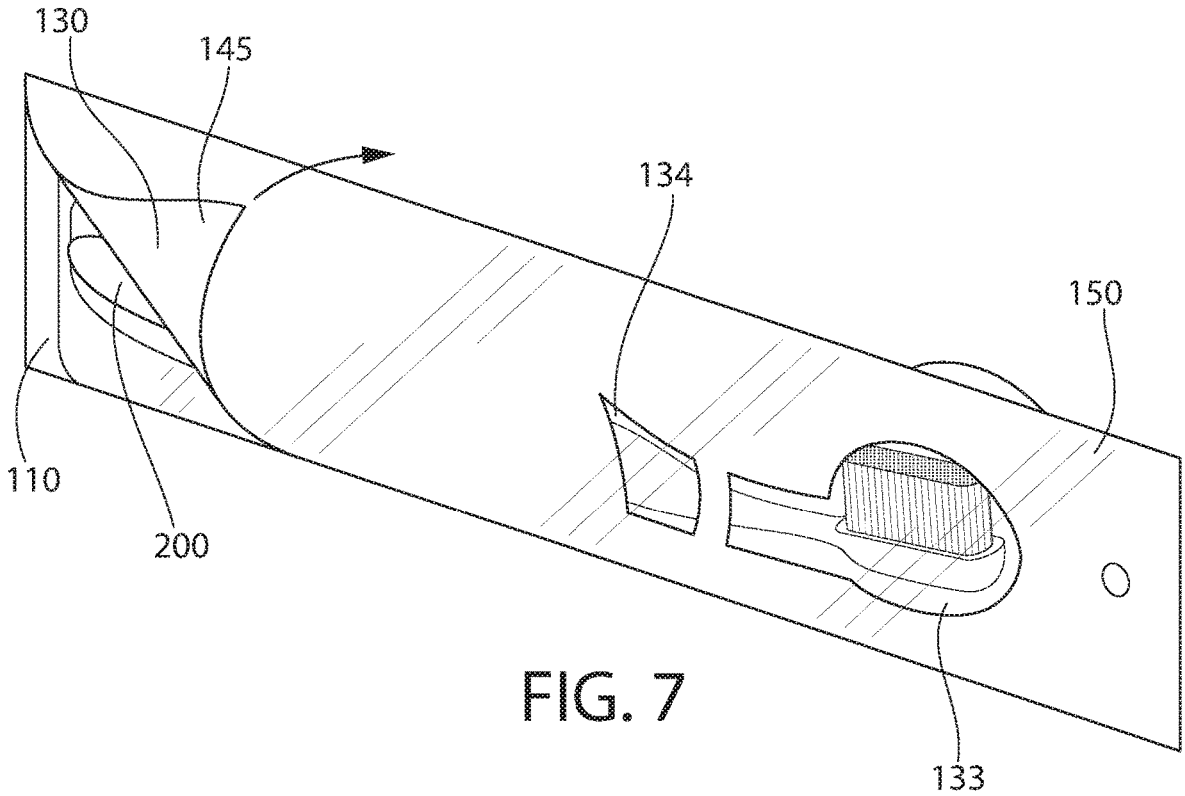
FIGS. 7 and 8 illustrate the section of the packaged set of oral care implements of FIG. 6 being opened to provide a user with access to the oral care implement contained therein.
Figure 8:
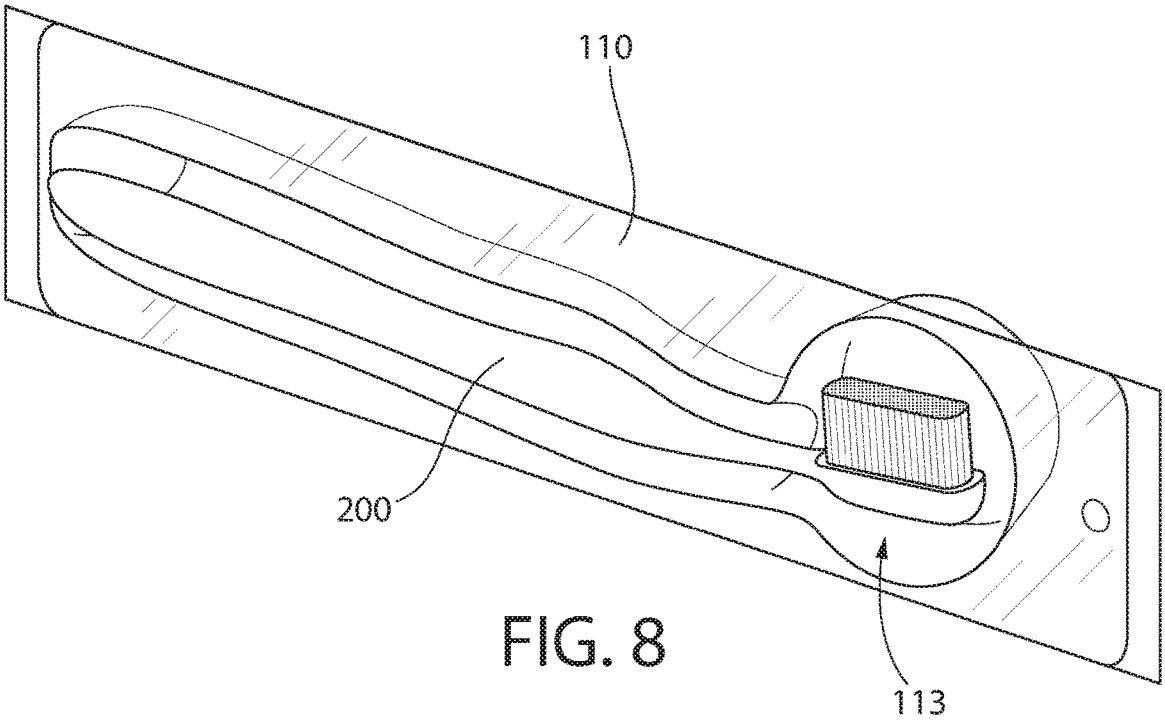

Referring to FIGS. 6-8, as described above each of the sections 161 of the package 100 can be detached from a remainder of the package 100 by tearing along the pre-weakened area 160 surrounding that particular section 161. FIG. 6 illustrates one of the sections 161 being separated from a remainder of the package 100. As can be seen, the package 100 comprises a perimeter portion 190 that surrounds the plurality of sections 161 so that even when all of the sections 161 are detached, the perimeter portion 190 remains intact. One of the sections 161 may be detached by a consumer at the retail location prior to purchase or the sections 161 may be detached by a retail store employee prior to displaying the oral care implements 200 for sale. As discussed above, each of the sections 161 comprises a portion of the flat panel 130, a portion of the blister package 110, and a portion of the transparent film 150. Furthermore, one of the oral care implements 200 is positioned within each of the sections 161.

In some embodiments, the invention may be directed to a single one of the sections 161. Each of the sections 161 includes the flat panel 130, the first and second window apertures 133, 134, the blister package 110, and the transparent film 150. Furthermore, each of the sections 161 contains one of the oral care implements 200. Thus, the invention may be directed to a packaged oral care implement that includes a package that comprises the blister package 110, the flat panel 130, and the transparent film 150 as described herein as well as one of the oral care implements 200. In one embodiment, the section 161 that is illustrated in FIG. 6 removed from the remainder of the package 100 may form the entirety of the packaged oral care implement claimed herein.

Next, referring to FIGS. 1 and 7, the section 161 can be opened to expose the oral care implement 200 contained therein. In that regard, in some embodiments a portion of the flat panel 130 and the blister package 110 located along a corner of the section 161 may be separated or otherwise not adhered to one another. As a result, a tab 145 is formed along that corner for separating the flat panel 130 from the blister package 100 to enable a user to remove the oral care implement 200. In some embodiments, there may be indicia 146 located along the tab 145 to identify the tab 145 (see FIG. 1).

FIG. 8 illustrates the oral care implement 200 located within the receiving cavity 113 of the blister package 110 of one section of the package 100 after the flat panel 130 has been separated from the blister package 110. Once so opened, a user can remove the oral care implement 200 from the receiving cavity 113 of the blister package 110 and use the oral care implement 200 in a traditional manner for oral hygiene activities.

While the foregoing description and drawings represent the exemplary embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

What is claimed is:

1. A packaged oral care implement comprising:

a package having a front surface and an opposite rear surface, the package comprising:

a blister package comprising a plurality of receiving cavities spaced apart from one another and having an open rear end;

a flat panel comprising a front surface, a rear surface opposite the front surface, a plurality of first window apertures, the flat panel coupled to the blister package so that the rear surface of the flat panel closes the open rear end of the receiving cavities, and a plurality of second window apertures formed through the flat panel, wherein the first and second window apertures are spaced apart by a bridge portion of the flat panel, wherein one of the first window apertures and one of the second window apertures is aligned with each of the plurality of receiving cavities; and a transparent film coupled to the front surface of the flat panel and covering the first window aperture and the second window aperture; and a plurality of oral care implements positioned within the receiving cavities of the blister package such that each of the plurality of oral care implements is positioned within one of the plurality of receiving cavities of the blister package, wherein the plurality of oral care implements are visible from the rear surface of the package through the blister package and from the front surface of the package through the first and second window apertures;

wherein the package comprises pre-weakened areas that divide the package into a plurality of sections, each of the plurality of sections comprising a portion of the blister package that includes one of the plurality of receiving cavities, a portion of the flat panel, and a portion of the transparent film, wherein each of the plurality of sections can be detached from a remainder of the package by tearing along the pre-weakened area surrounding that section; and wherein the package comprises a perimeter portion that surrounds the plurality of sections, the perimeter portion remaining intact when the sections are detached.

2. The packaged oral care implement according to claim 1 wherein the transparent film is a non-heat sealable laminate.

3. The packaged oral care implement according to claim 2 wherein the transparent film is coupled to the front surface of the flat panel with an adhesive.

4. The package oral care implement according to claim 1 wherein the transparent film is selected from the group consisting of biaxially oriented polypropylene (BOPP), recycled polyethylene terephthalate (RPET), and polyvinyl chloride (PVC) having a thickness between 10 and 50 microns.

5. The packaged oral care implement according to claim 1 wherein the flat panel is formed from a paperboard material and wherein the front and rear surfaces of the flat panel are planar.

6. The packaged oral care implement according to claim 1 wherein the transparent film covers an entirety of the front surface of the flat panel.

7. The packaged oral care implement according to claim 1 further comprising indicia on the front surface of the flat panel along the bridge portion that is indicative of a characteristic of the oral care implement, wherein the indicia is a depiction of a spring to indicate that the oral care implement is flexible.

8. The packaged oral care implement according claim 1 wherein the first window aperture comprises a linear portion and a bulbous portion and the second window aperture has a generally trapezoidal shape, wherein a neck and a head of the oral care implement is exposed through the first window aperture and wherein a proximal portion of a handle of the oral care implement that is adjacent to the neck is exposed through the second window aperture.

9. The packaged oral care implement according to claim 1 wherein the bridge portion has a convex upper edge that defines an end of the first window aperture and a concave lower edge that defines an end of the second window aperture, wherein the ends of the first and second window apertures are complementary in shape, thereby giving the first and second window apertures a collective seamless appearance.

10. The packaged oral care implement according to claim 1 wherein an entirety of the oral care implement is visible from the rear surface of the package through the blister package and wherein a head, a neck, and less than one-half of a handle of the oral care implement is visible from the front surface of the package through the first and second window apertures.

11. The packaged oral care implement according to claim 1 wherein the pre-weakened areas comprise a plurality of discrete attachment points that are spaced apart from one another so that adjacent sections are only physically attached at the discrete attachment points, wherein none of the discrete attachment points are aligned with the first and second window apertures.

12. The packaged oral care implement according to claim 1 wherein for each of the sections of the package, a portion of the flat panel and the blister package located along a corner of the section are not adhered to one another, thereby forming a tab for opening the section to remove the oral care implement located therein, wherein the tab comprises visual indicia for identifying the tab.

13. The packaged oral care implement according to claim 1 wherein the blister package comprises a thermoformed plastic film having a three-dimensional contour that forms the receiving cavity, wherein the three-dimensional contour generally corresponds in shape to the oral care implement.

14. The packaged oral care implement according to claim 1 wherein the transparent film on the front surface of the flat panel forms at least a portion of the front surface of the package.

15. The packaged oral care implement according to claim 1 wherein the oral care implement is a toothbrush comprising a head having a plurality of tooth cleaning elements extending therefrom, a handle, and a neck extending between the head and the handle, and wherein when viewed from the front surface of the package, the head, the tooth cleaning elements, and at least a portion of the neck are visible through the first window aperture and a proximal portion of the handle that is adjacent to the neck is visible through the second window aperture formed through the flat panel.

16. The packaged oral care implement according to claim 1 wherein the first and second window apertures and the bridge portion of the flat panel collectively have a shape that corresponds with a shape of an upper portion of the plurality of oral care implements, wherein each of the oral care implements extends along a longitudinal axis, and wherein the bridge portion of the flat panel is elongated in a direction transverse to the longitudinal axis.

17. The packaged oral care implement according to claim 1 wherein the package further comprises a hanging element for hanging the package from a hook in a retail environment, and wherein the front surface of the flat panel forms a display side of the flat panel that is exposed to a consumer when the package is hanging in the retail environment.

18. A packaged set of oral care implements comprising:

a package having a front surface and an opposite rear surface, the package comprising:

a blister package comprising a plurality of receiving cavities having an open rear end;

a flat panel coupled to the blister package so that a rear surface of the flat panel closes the open rear end of each of plurality of receiving cavities, the package comprising a plurality of pre-weakened areas that divide the flat panel into a plurality of sections such that each of the plurality of sections is aligned with one of the plurality of receiving cavities, wherein each of the plurality of sections comprises a first window aperture;

a transparent film coupled to a front surface of the flat panel that is opposite the rear surface of the flat panel, the transparent film covering the first window aperture, wherein the transparent film is non-heat sealable; and a plurality of oral care implements positioned between the blister pack and the flat panel so that each of the plurality of oral care implements is positioned within one of the plurality of receiving cavities, wherein each of the oral care implements is visible from the rear surface of the package through the blister package and from the front surface of the package through the first window aperture;

wherein the pre-weakened areas comprise a plurality of discrete attachment points that are spaced apart from one another so that adjacent sections are only physically attached at the discrete attachment points, wherein none of the discrete attachment points are aligned with the first window aperture.

19. The packaged set oral care implement according to claim 18 wherein each of the plurality of sections of the flat panel comprises a second window aperture formed through the flat panel that is spaced apart from the first window aperture by a bridge portion of the flat panel, wherein the transparent film covers the second window aperture, and wherein an oral care implement of the plurality of oral care implements are visible from the front surface of the package through the second window aperture.

* * * * *